United States Patent [19]

Suga

[11] 4,006,380

[45] Feb. 1, 1977

[54] MOUNTING OF CARBON ELECTRODES ON A HOLDER OF AN ARC LAMP

[76] Inventor: Shigeru Suga, Yoyogi 5-20-2, Shibuya, Tokyo, Japan

[22] Filed: Oct. 31, 1975

[21] Appl. No.: 627,880

[52] U.S. Cl. ..... 313/357; 313/238; 313/267; 13/15; 314/51; 314/101

[51] Int. Cl.[2] ..... H01J 1/00; H01J 17/04; H01J 19/00

[58] Field of Search ..... 313/357, 238, 267; 13/15, 16; 314/51, 52, 101, 102, 113

[56] References Cited

UNITED STATES PATENTS

| | | | |
|---|---|---|---|
| 824,153 | 6/1906 | Seward | 313/238 X |
| 881,519 | 3/1908 | Wilson | 313/357 X |
| 2,286,755 | 6/1942 | Morton et al. | 313/238 |
| 3,727,095 | 4/1973 | Hesselmann | 313/357 |

*Primary Examiner*—Saxfield Chatmon, Jr.
*Attorney, Agent, or Firm*—Wenderoth, Lind & Ponack

[57] ABSTRACT

The present invention relates to a mounting of carbon electrodes on a holder of an arc lamp used as a light source for a weatherometer or a lightfastness tester. In the holder, one end of the carbon electrodes and the holder are threadedly connected with each other.

3 Claims, 5 Drawing Figures

MOUNTING OF CARBON ELECTRODES ON A HOLDER OF AN ARC LAMP

BACKGROUND OF THE INVENTION AND PRIOR ART

The carbon electrode holders for an arc lamp used as a light source in a conventional weatherometer or lightfastness tester mostly comprise receptacles for receiving three or four carbon rods which act as the electrodes, and metal support members for pressing the carbon rods into the receptacles, as illustrated in FIGS. 1–3. Typical configurations of these conventional holders are also illustrated in FIGS. 2 and 3.

The receptacle 1 of the holder shown in FIG. 2 has four holes 2 thereon, each being defined by an upper ring *a* and a lower ring *b*. A carbon electrode C is inserted into each hole 2 and extends through the upper and lower rings *a* and *b*, and the electrodes are clamped and fixed in position by T-shaped metal supports 3 and 3' which are attached to the receptacle 1 by a bolt 4 extending transversely through the receptacle 1 relative to the rods and having nut 5 on the end thereof.

The receiving section of the receptacle 6 of the holder shown in FIG. 3 has rectangular recesses therein in which two carbon electrodes C are held, each being pressed against two perpendicular surfaces *c* and *d*. The metal supports 7 and 7' have the shape of a wedge, and are clamped by the bolt 8 extending transversely through the receptacle relative to the carbon electrodes C and having a nut 9 thereon. Since the support member has a wedge shape, the carbon electrodes C are each pressed against the two surfaces c and d and held thereagainst by a strong force.

The carbon electrodes C in these conventional holders shown in FIGS. 2 and 3 are held by means of the clamping action of the bolt and nut. If the bolt and nut somehow come loose, therefore, the carbon electrodes also get loose, and sometimes slip out of the receptacle during use of the apparatus.

In addition, the electrodes in the conventional holders like those of FIG. 3 are in linear contact in the longitudinal direction thereof with the receptacle. For this reason, the effective contact area of the carbon electrodes is rather small. Since a large current, such as for example 60A, passes through this small contact area, thermal oxidation tends to take place at this contact point, if the electric contact-resistance increases even to a small extent. The thermal oxidation, in turn, deterioriates the electric contact, thus resulting in an endles vicious cycle.

In order to prevent these undesirable sequences of events, it has heretofore been imperative to polish the contact surface to make it clean and thus ensure a good electric contact every time the apparatus is used.

OBJECT OF THE INVENTION

The present invention is directed to a mounting which overcomes the abovementioned problems of the conventional holders. In accordance with the present invention, the carbon electrodes and the holder are threaded to each other.

Figure 1:
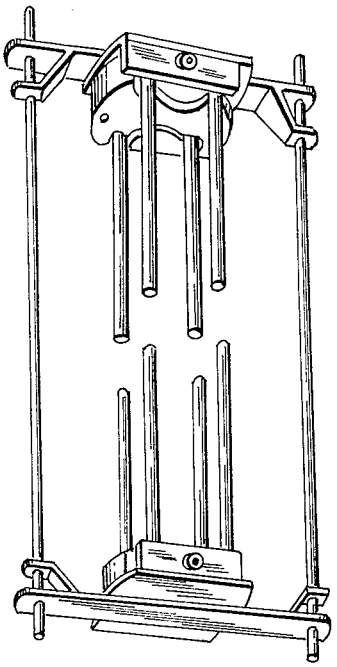
(PRIOR ART) FIG.1
FIG. 1 is a perspective view of a conventional holder for carbon electrodes for an arc lamp used as a light source for a weatherometer or a lightfastness tester.
Figure 2:
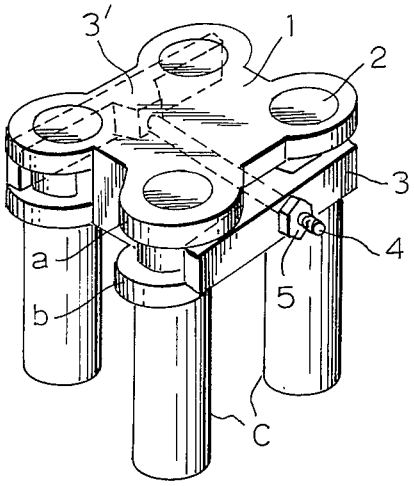
(PRIOR ART) FIG.2
FIGS. 2 and 3 are perspective views showing the construction of other conventional carbon electrode holders for an arc lamp used as a light source for a weatherometer or a lightfastness tester.
Figure 4:
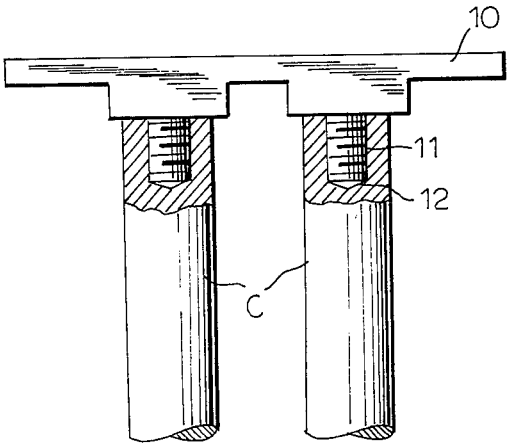
FIGS. 4 and 5 are partial sectional views of the joint between carbon electrodes and a holder in accordance with the present invention.
Figure 3:
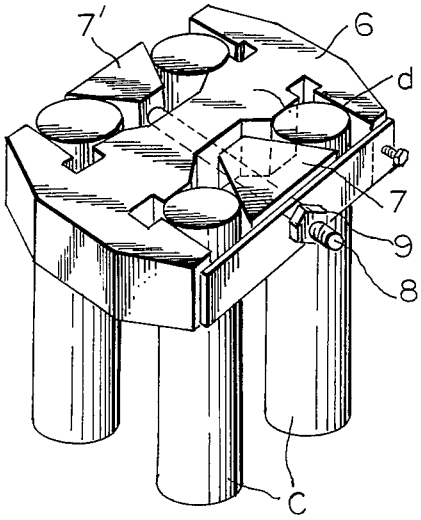
(PRIOR ART) FIG.3

In the embodiment shown in FIG. 4, a female threaded hole 12 is bored in one end of each of the carbon electrodes C on the central axis thereof, and bolts 11 on the plate-shaped carbon electrode holder 10, which is of an electrically conductive material, are threaded into the holes 12. Mounting of the carbon electrodes C is effected by screwing each carbon electrode C onto a corresponding bolt 11 on the holder 10.

Figure 5:
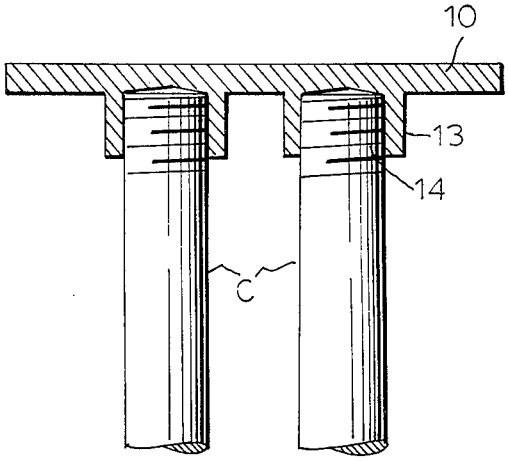

In the embodiment shown in FIG. 5, on the other hand, a male thread 14 is provided around the outer periphery at the one end of each of the carbon electrodes C and the holder 10 has four female threaded sockets 13.

In the abovedescribed arrangement, the contact area between the carbon electrode and the plate-shaped holder extends throughout the entire area of the threaded section as well as the bottom surface; hence, the contact area in the present invention is more than 10 times larger than that of the conventional holders. As a consequence, the current is distributed over all the contact area so that the current density is low so that the thermal oxidation is reduced to a marked extent.

Moreover, in the conventional holders, the contact area and the areas therearound are exposed to the air, and for this reason they are all the more susceptible to the oxidation. Consequently, the contact resistance between the carbon electrode and the holder increases so as to result in unstability of the discharge current and voltage. In the present invention, on the other hand, the contact area is not exposed to the air and air oxidation is thus avoided.

In the present invention, even considerable looseness during the screwing operation does not cause the carbon electrode to come off the holder because the electrode and the holder are threadedly engaged with each other. In addition, the screwing operation is, in a sense, a polishing operation which always produces some polishing of the contact area and improves the electrical contact.

In addition, in accordance with the present invention, the length of the carbon electrode required for securing to the holder is approximately half that required with the conventional holder. Hence, the length of the carbon electrode which can be burned is greater. For example, a conventional holder for four carbon electrodes can be operated for a maximum period of 22 hours, whereas when four electrodes are mounted in accordance with the present invention, the maximum period of operation is up to 24 hours, thus resulting in more efficient use of material. Additionally, the simplified construction of the present holder leads to substantial cost savings in its production.

What is claimed is:

1. In combination, a plate-shaped holder for a plurality of carbon electrodes for use in an arc lamp for a weatherometer or a light fastness tester, said holder being of an electrically conductive material having a plurality of threaded portions projecting from the surface of said plate-shaped holder corresponding to the number of electrodes to be held thereon, and a plurality of carbon electrodes each having a threaded portion on one end thereof, said electrodes being mounted on said holder and electrically connected thereto solely by the threaded engagement with a corresponding threaded projection on said holder.

2. The combination as claimed in claim 1 in which the threaded portions on said holder are male threaded bolts and the threaded portions on said electrodes are female threaded bores in the end of the electrodes on the axis of the electrodes.

3. The combination as claimed in claim 1 in which the threaded portions on said holder are female threaded recesses and the threaded portions on said electrodes are male threaded end portions of the electrodes.

* * * * *